US008851595B2

(12) United States Patent
Itogawa et al.

(10) Patent No.: US 8,851,595 B2
(45) Date of Patent: Oct. 7, 2014

(54) LIQUID DISCHARGER AND IMAGE FORMING APPARATUS HAVING THE SAME

(75) Inventors: Yoshihiro Itogawa, Gifu (JP); Takashi Suzuki, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 217 days.

(21) Appl. No.: 13/248,561

(22) Filed: Sep. 29, 2011

(65) Prior Publication Data

US 2012/0081423 A1 Apr. 5, 2012

(30) Foreign Application Priority Data

Sep. 30, 2010 (JP) ..... 2010-221539

(51) Int. Cl.

| | |
|---|---|
| ***B41J 2/195*** | (2006.01) |
| ***B41J 29/393*** | (2006.01) |
| ***B41J 2/21*** | (2006.01) |
| ***B41J 2/175*** | (2006.01) |

(52) U.S. Cl.

CPC ..... *B41J 2/2114* (2013.01); *B41J 2/17566* (2013.01); *B41J 2/17509* (2013.01); *B41J 2002/17589* (2013.01)

USPC ..... 347/7; 347/19

(58) Field of Classification Search

CPC ..... B41J 2/17566; B41J 2002/17589; B41J 2/2114; B41J 2/211

See application file for complete search history.

(56) References Cited

U.S. PATENT DOCUMENTS

| | | | | |
|---|---|---|---|---|
| 5,635,969 | A | 6/1997 | Allen | |
| 5,663,750 | A | 9/1997 | Sakuma | |
| 6,012,809 | A | 1/2000 | Ikeda et al. | |
| 6,123,411 | A | 9/2000 | Inui et al. | |
| 6,299,285 | B1 | 10/2001 | Inui | |
| 8,579,429 | B2 * | 11/2013 | Itogawa | 347/101 |
| 2002/0167556 | A1 | 11/2002 | Suenaga et al. | |
| 2002/0167572 | A1 | 11/2002 | Heim et al. | |

(Continued)

FOREIGN PATENT DOCUMENTS

| | | | |
|---|---|---|---|
| CN | 1746027 | A | 3/2006 |
| EP | 1 747 892 | A1 | 1/2007 |

(Continued)

OTHER PUBLICATIONS

Extended European Search Report and Search Opinion dated May 29, 2012 from related European Application No. 11181829.0.

(Continued)

*Primary Examiner* — Geoffrey Mruk

(74) *Attorney, Agent, or Firm* — Scully, Scott, Murphy & Presser, P.C.

(57) ABSTRACT

A liquid discharger is provided, which includes a condition determining unit configured to, based on a remaining amount of first liquid detected by a first liquid remaining amount detector and a remaining amount of second liquid detected by a second liquid remaining amount detector, determine whether a predetermined condition is satisfied under a situation where the remaining amount of the second liquid is less than the remaining amount of the first liquid. When the condition determining unit determines that the predetermined condition is satisfied, a second liquid discharge head is controlled to discharge onto image formation areas the second liquid of an amount smaller than an amount of the second liquid to be discharged onto the image formation areas in a case where the condition determining unit determines that the predetermined condition is not satisfied.

18 Claims, 6 Drawing Sheets

(56) References Cited

U.S. PATENT DOCUMENTS

| | | | |
|---|---|---|---|
| 2007/0126836 | A1 | 6/2007 | Masuyama et al. |
| 2007/0211097 | A1 | 9/2007 | Yamazaki et al. |
| 2008/0094430 | A1 | 4/2008 | Richards et al. |

FOREIGN PATENT DOCUMENTS

| | | | | |
|---|---|---|---|---|
| JP | 7-195823 | A | 8/1995 | |
| JP | 7-276664 | A | 10/1995 | |
| JP | 8-216391 | A | 8/1996 | |
| JP | 08281974 | A | 10/1996 | |
| JP | 9-254376 | A | 9/1997 | |
| JP | 10-226057 | A | 8/1998 | |
| JP | 2004142185 | A | 5/2004 | |
| JP | 2005-178009 | A | 7/2005 | |
| JP | 2007-152850 | A | 6/2007 | |
| JP | 2009154337 | A | 7/2009 | |
| WO | WO 2009/157973 | A1 * | 12/2009 | ..... B41J 2/175 |

OTHER PUBLICATIONS

Notification of Reasons for Rejection dated Dec. 24, 2013 issued in the Japanese counterpart application No. 2010-221539.

First Office Action dated Nov. 28, 2013 issued in the Chinese counterpart application No. 201110289275.8, together with English language translation.

* cited by examiner

FIG.4A

| | | | | | | | | | |
|---|---|---|---|---|---|---|---|---|---|
| M | M | M | | | | | | | |
| M | M | M | M | | | | | | |
| M | M | M | M | | | | | | |
| M | M | M | M | M | | | | | |
| M | M | M | M | M | | | | | |
| M | M | M | M | M | M | | | | |
| M | M | M | M | M | M | | | | |
| M | M | M | M | M | M | M | | | |
| M | M | M | M | M | M | M | | | |
| M | M | M | M | M | M | M | M | | |

FIG.4B

| | | | | | | | | | |
|---|---|---|---|---|---|---|---|---|---|
| M | M | M | | | | | | | |
| M | M | M | M | | | | | | |
| M | M | M | M | | | | | | |
| M | M | M | M | M | | | | | |
| M | M | M | M | M | | | | | |
| M | M | M | M | M | M | | | | |
| M | M | M | M | M | M | | | | |
| M | M | M | M | M | M | M | | | |
| M | M | M | M | M | M | M | | | |
| M | M | M | M | M | M | M | M | | |

FIG.4C

| | | | | | | | | | |
|---|---|---|---|---|---|---|---|---|---|
| L | M | M | | | | | | | |
| M | L | M | M | | | | | | |
| M | M | L | M | | | | | | |
| M | M | M | M | M | | | | | |
| M | M | M | M | M | | | | | |
| L | M | M | M | M | M | | | | |
| M | L | M | M | M | M | | | | |
| M | M | L | M | M | M | M | | | |
| L | M | M | L | M | M | M | | | |
| M | L | M | M | L | M | M | M | | |

FIG.4D

| | | | | | | | | | |
|---|---|---|---|---|---|---|---|---|---|
| | M | M | | | | | | | |
| M | | M | M | | | | | | |
| M | M | | M | | | | | | |
| M | M | M | M | M | | | | | |
| M | M | M | M | M | | | | | |
| | M | M | M | M | M | | | | |
| M | | M | M | M | M | | | | |
| M | M | | M | M | M | M | | | |
| | M | M | | M | M | M | | | |
| M | | M | M | | M | M | M | | |

FIG.4E

| | | | | | | | | | |
|---|---|---|---|---|---|---|---|---|---|
| L | L | M | | | | | | | |
| L | L | M | M | | | | | | |
| L | L | L | S | | | | | | |
| L | L | L | M | M | | | | | |
| L | L | L | L | S | | | | | |
| L | L | L | L | M | M | | | | |
| L | L | L | L | L | S | | | | |
| L | L | L | L | L | M | M | | | |
| L | L | L | L | L | L | S | | | |
| L | L | L | L | L | L | M | M | | |

FIG.4F

| | | | | | | | | | |
|---|---|---|---|---|---|---|---|---|---|
| S | S | M | | | | | | | |
| S | S | M | M | | | | | | |
| S | S | S | | | | | | | |
| S | S | S | M | M | | | | | |
| S | S | S | S | | | | | | |
| S | S | S | S | M | M | | | | |
| S | S | S | S | S | | | | | |
| S | S | S | S | S | M | M | | | |
| S | S | S | S | S | S | | | | |
| S | S | S | S | S | S | M | M | | |

FIG.4G

| | | | | | | | | | |
|---|---|---|---|---|---|---|---|---|---|
| L | M | M | | | | | | | |
| M | L | M | M | | | | | | |
| M | M | L | S | | | | | | |
| M | M | M | M | M | | | | | |
| M | M | M | M | S | | | | | |
| L | M | M | M | M | M | | | | |
| M | L | M | M | M | S | | | | |
| M | M | L | M | M | S | M | | | |
| L | M | M | L | M | S | S | | | |
| M | L | M | M | L | S | M | M | | |

FIG.4H

| | | | | | | | | | |
|---|---|---|---|---|---|---|---|---|---|
| S | M | M | | | | | | | |
| M | S | M | M | | | | | | |
| M | M | S | S | | | | | | |
| M | M | M | M | M | | | | | |
| M | M | M | M | S | | | | | |
| S | M | M | M | M | M | | | | |
| M | S | M | M | M | S | | | | |
| M | M | S | M | M | M | M | | | |
| S | M | M | S | M | M | S | | | |
| M | S | M | M | S | M | M | M | | |

LIQUID DISCHARGER AND IMAGE FORMING APPARATUS HAVING THE SAME

CROSS-REFERENCE TO RELATED APPLICATION

This application claims priority under 35 U.S.C. §119 from Japanese Patent Application No. 2010-221539 filed on Sep. 30, 2010. The entire subject matter of the application is incorporated herein by reference.

BACKGROUND

1. Technical Field

The following description relates to one or more techniques to, prior to discharging first liquid for image formation, discharge onto a recording medium second liquid for agglutinating or precipitating one or more components contained in the first liquid. In particular, the following description relates to one or more techniques for an image forming apparatus configured such that a liquid cartridge is attached thereto that includes a first liquid tank for storing the first liquid and a second liquid tank for storing the second liquid.

2. Related Art

So far, an image forming apparatus has been known that is configured to discharge second liquid for enhancing image quality onto a sheet (a recording medium) and thereafter discharge first liquid for image formation into a position on the sheet where the second liquid is discharged. It makes the first liquid fixed on the sheet easily and quickly. Consequently, it is possible to avoid so-called "bleedthrough" and enhance the image density of a resulting image.

As a liquid supply source applicable to the image forming apparatus, an integrated type of liquid cartridge has been known that has a single cartridge body including a first liquid tank for storing the first liquid and a second liquid tank for storing the second liquid. Thus, when the liquid supply source is configured as an integrated type of liquid cartridge as above, it is possible to simplify the configuration of the liquid supply source.

SUMMARY

The first liquid and the second liquid are consumed for various reasons such as image formation and maintenance of two types of heads that discharge the first liquid and the second liquid, respectively. The first liquid and the second liquid are not necessarily consumed at a constant rate. Therefore, in the integrated type of liquid cartridge, it often happens that one of the first liquid and the second liquid is completely consumed ahead of the other. When the first liquid is completely consumed ahead of the second liquid, it is impossible to form an image only with the second liquid. Hence, even though the second liquid still remains, the liquid cartridge has to be replaced with another one.

Meanwhile, when the second liquid is completely consumed ahead of the first liquid, it is possible to form an image as the first liquid remains. Nevertheless, when the second liquid has to be used for image formation in order to avoid bleedthrough and/or ensure a predetermined level of image density, the liquid cartridge needs to be exchanged. However, the aforementioned undesired situation may be improved by changing the way to use the second liquid when both the first liquid and the second liquid remain from an initial way.

Aspects of the present invention are advantageous to provide one or more improved techniques for an image forming apparatus configured such that an integrated type of liquid cartridge is attached thereto, which techniques make it possible to render small an amount of the first liquid remaining when the second liquid is completely consumed.

According to aspects of the present invention, a liquid discharger is provided, which includes a liquid cartridge having a first liquid tank configured to store first liquid for forming an image on a sheet and a second liquid tank configured to store second liquid that acts on the first liquid, an attachment unit configured such that the liquid cartridge is attached thereto, a first liquid discharge head configured to discharge, onto the sheet, the first liquid supplied from the first liquid tank, a second liquid discharge head configured to discharge, onto the sheet, the second liquid supplied from the second liquid tank, a storage unit configured to store image data of the image to be formed on the sheet, a first liquid discharge controller configured to control the first liquid discharge head to discharge the first liquid onto image formation areas on the sheet where the image is formed, based on the image data stored in the storage unit, a second liquid discharge controller configured to control the second liquid discharge head to discharge the second liquid onto at least a part of the image formation areas, based on the image data stored in the storage unit, a first liquid remaining amount detector configured to detect a remaining amount of the first liquid stored in the first liquid tank, a second liquid remaining amount detector configured to detect a remaining amount of the second liquid stored in the second liquid tank, and a condition determining unit configured to, based on the remaining amount of the first liquid detected by the first liquid remaining amount detector and the remaining amount of the second liquid detected by the second liquid remaining amount detector, determine whether a predetermined condition is satisfied under a situation where the remaining amount of the second liquid is less than the remaining amount of the first liquid. When the condition determining unit determines that the predetermined condition is satisfied, the second liquid discharge controller controls the second liquid discharge head to discharge onto the image formation areas the second liquid of an amount smaller than an amount of the second liquid to be discharged onto the image formation areas in a case where the condition determining unit determines that the predetermined condition is not satisfied.

According to aspects of the present invention, further provided is an image forming apparatus configured to form an image on a sheet while discharging first liquid onto the sheet, which includes a feeding mechanism configured to feed the sheet in a feeding direction, and a liquid discharger. The liquid discharger includes a liquid cartridge having a first liquid tank configured to store first liquid for forming the image on the sheet and a second liquid tank configured to store second liquid that acts on the first liquid, an attachment unit configured such that the liquid cartridge is attached thereto, a first liquid discharge head configured to discharge, onto the sheet being fed by the feeding mechanism, the first liquid supplied from the first liquid tank, a second liquid discharge head configured to discharge, onto the sheet being fed by the feeding mechanism, the second liquid supplied from the second liquid tank, a storage unit configured to store image data of the image to be formed on the sheet, a first liquid discharge controller configured to control the first liquid discharge head to discharge the first liquid onto image formation areas on the sheet where the image is formed, based on the image data stored in the storage unit, a second liquid discharge controller configured to control the second liquid discharge head to discharge the second liquid onto at least a part of the image formation areas, based on the image data stored in the storage unit, a first liquid remaining amount detector configured to detect a remaining amount of the first liquid stored in the first liquid tank, a second liquid remaining amount detector configured to detect a remaining amount of the second liquid stored in the second liquid tank, and a condition determining unit configured to, based on the remaining amount of the first liquid detected by the first liquid remaining amount detector and the remaining amount of the second liquid detected by the second liquid remaining amount detector, determine whether a predetermined condition is satisfied under a situation where the remaining amount of the second liquid is less than the remaining amount of the first liquid. When the condition determining unit determines that the predetermined condition is satisfied, the second liquid discharge controller controls the second liquid discharge head to discharge onto the image formation areas the second liquid of an amount smaller than an amount of the second liquid to be discharged onto the image formation areas in a case where the condition determining unit determines that the predetermined condition is not satisfied.

BRIEF DESCRIPTION OF THE ACCOMPANYING DRAWINGS

Figure 3:
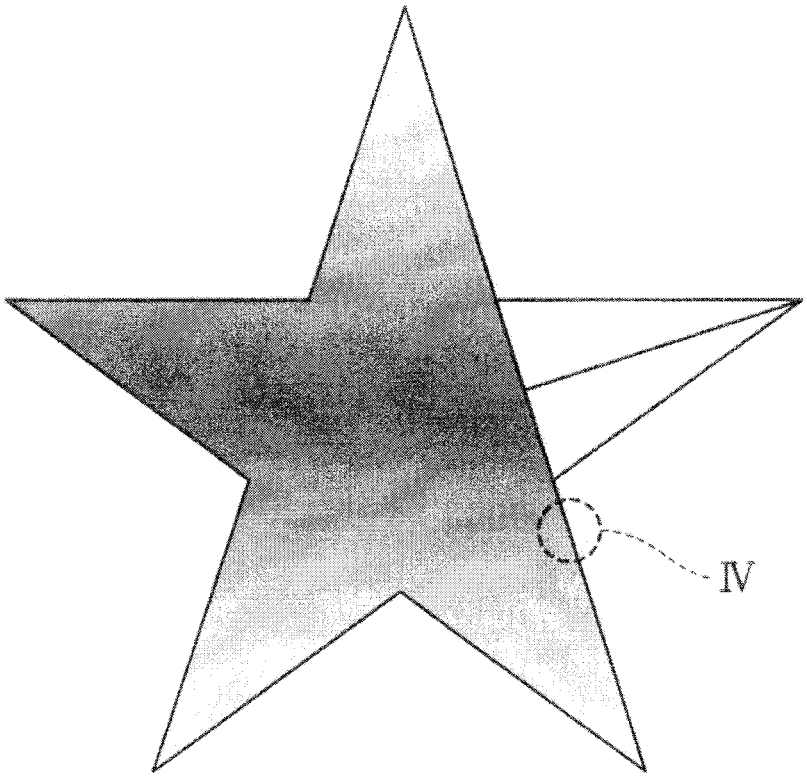

FIG. 3 exemplifies an image to be formed on a recording side of a sheet by the inkjet printer in the embodiment according to one or more aspects of the present invention.

FIGS. 4A and 4B show examples of ink discharge data and of processing liquid discharge data of an area IV shown in FIG. 3 in the case where a predetermined condition is not satisfied, respectively, in the embodiment according to one or more aspects of the present invention.

FIGS. 4C and 4D show examples of the ink discharge data and the processing liquid discharge data of the area IV shown in FIG. 3 in the case where the predetermined condition is satisfied, respectively, in the embodiment according to one or more aspects of the present invention.

FIGS. 4E and 4F show modifications of the ink discharge data and the processing liquid discharge data of the area IV shown in FIG. 3 in the case where the predetermined condition is satisfied, respectively, in the embodiment according to one or more aspects of the present invention.

FIGS. 4G and 4H show modifications of the ink discharge data and the processing liquid discharge data of the area IV shown in FIG. 3 in the case where the predetermined condition is satisfied, respectively, in the embodiment according to one or more aspects of the present invention.

Figure 5A:
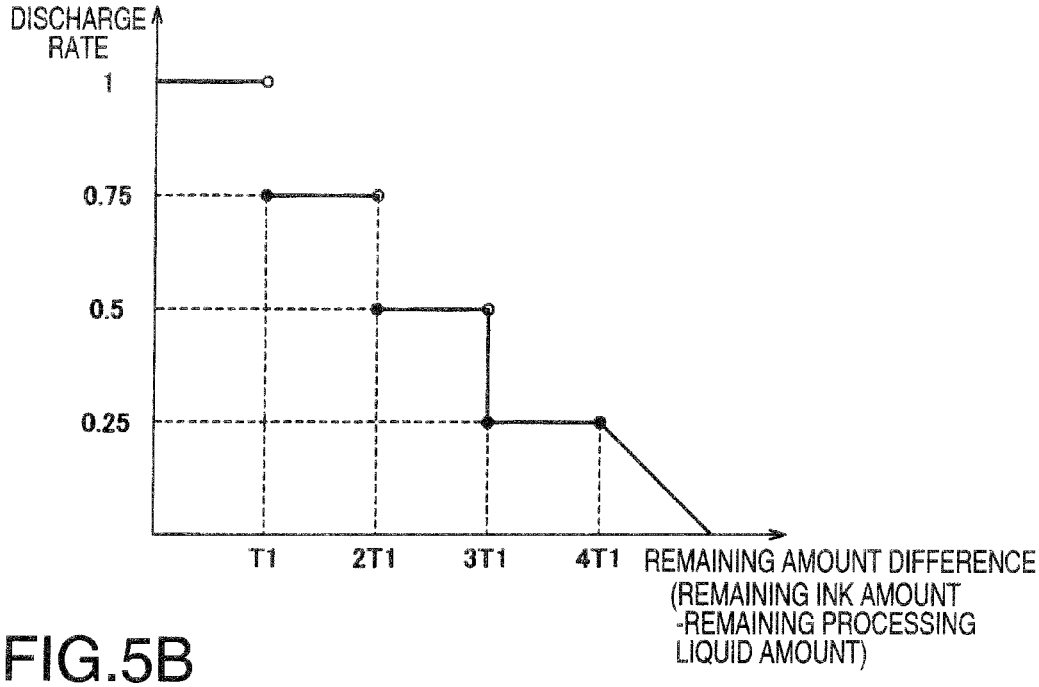

FIG. 5A is a graph exemplifying a relationship between a remaining amount difference and a discharge rate of the processing liquid in the case where the predetermined condition is satisfied in the embodiment according to one or more aspects of the present invention.

Figure 5B:
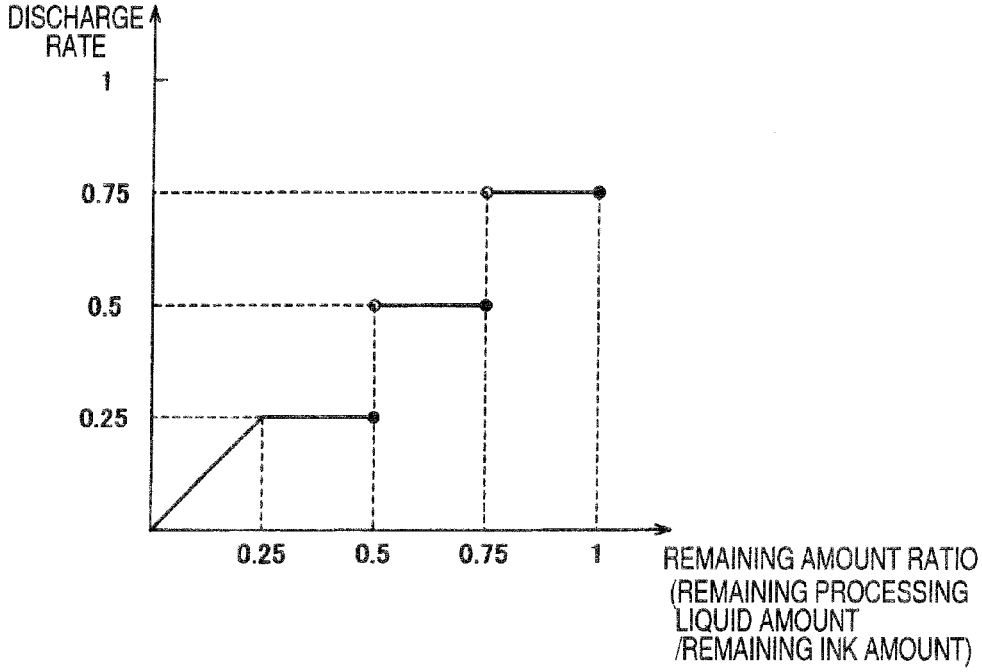

FIG. 5B is a graph exemplifying a relationship between a remaining amount ratio and the discharge rate of the processing liquid in the case where the predetermined condition is satisfied in the embodiment according to one or more aspects of the present invention.

Figure 6:
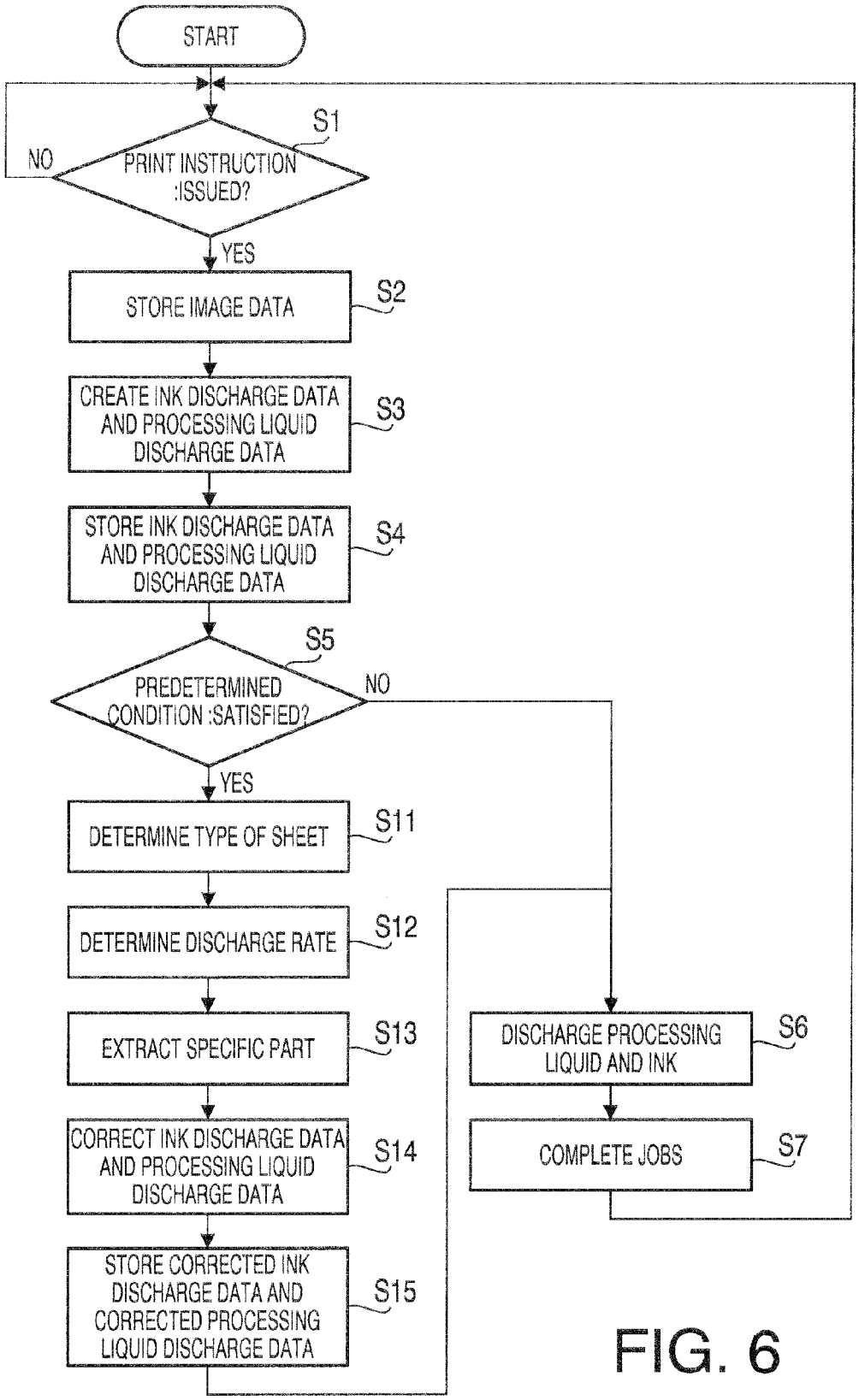

FIG. 6 is a flowchart showing a procedure of a process to be executed by the controller of the inkjet printer in the embodiment according to one or more aspects of the present invention.

DETAILED DESCRIPTION

It is noted that various connections are set forth between elements in the following description. It is noted that these connections in general and, unless specified otherwise, may be direct or indirect and that this specification is not intended to be limiting in this respect. Aspects of the invention may be implemented in computer software as programs storable on computer-readable media including but not limited to RAMs, ROMs, flash memories, EEPROMs, CD-media, DVD-media, temporary storage, hard disk drives, floppy drives, permanent storage, and the like.

Hereinafter, an embodiment according to aspects of the present invention will be described with reference to the accompanying drawings.

Figure 1:
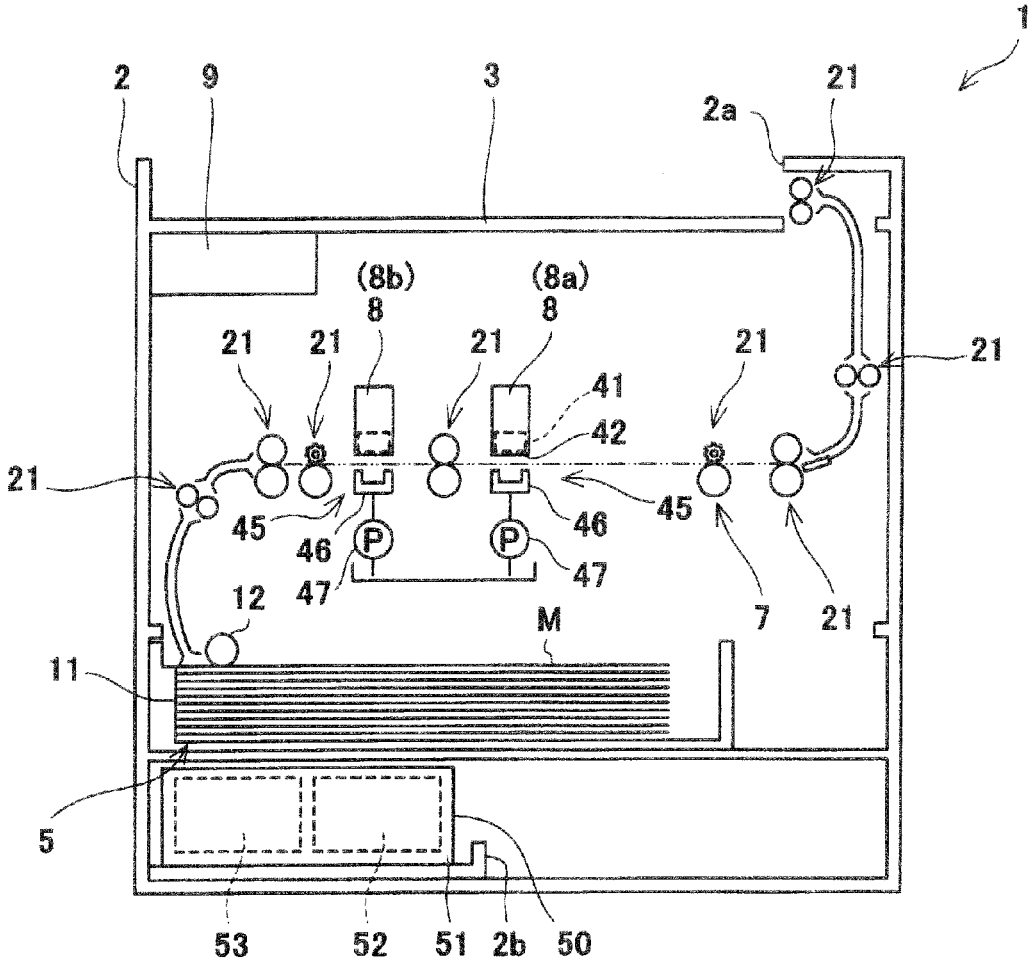
FIG. 1 is a side view schematically showing an overall configuration of an inkjet printer in an embodiment according to one or more aspects of the present invention.

As shown in FIG. 1, an inkjet printer 1 (hereinafter simply referred to as a printer 1) has a housing 2 formed substantially in a rectangular parallelepiped shape. At an upper side outside the housing 2, there is a catch tray 3 provided such that one or more printed sheets are placed thereon. Inside the housing 2, the printer 1 includes a sheet pickup mechanism 5, a feeding mechanism 7, two heads 8, and a controller 9. The controller 9 is configured to control operations of the sheet pickup mechanism 5, the feeding mechanism 7, and the heads 8.

The sheet pickup mechanism 5 includes a feed tray 11 and a pickup roller 12. The feed tray 11 is detachably disposed inside the housing 2, and formed in a box shape having an opening at an upper side thereof. The feed tray 11 is configured such that one or more sheets M are placed therein by a user in a vertically-stacked state. The pickup roller 12 is configured to contact a top one of the sheets M placed in the feed tray 11, from above. When the pickup roller 12 rotates, the top sheet M is fed onto a feeding path via the upper-side opening of the feed tray 11. Firstly, the feeding path extends upward from the upper-side opening of the feed tray 11. Then, the feeding path extends horizontally and linearly toward a right side in FIG. 1 inside the housing 2, and further extends upward. A downstream end of the feeding path (in a feeding direction in which the sheet M is conveyed) is continuous with the catch tray 3 via an ejection outlet 2*a* formed at an upper portion of the housing 2. The feeding mechanism 7 includes a plurality of roller pairs 21 that are disposed along the feeding path with a distance between each adjacent two of the roller pairs 21. Each roller pair 21 includes two rollers, i.e., a roller configured to contact a recording side of the sheet M and a roller configured to contact an opposite side of the recording side of the sheet M. At least one of the two rollers is a driving roller configured to be driven to rotate by a driving force from a motor (not shown). When the driving roller is driven to rotate, the sheet M fed via the opening of the feed tray 11 passes through one after another of the roller pairs 21 along the feeding path, and is finally conveyed onto the catch tray 3.

The two heads 8 include a recording head 8*a* configured to discharge ink for forming an image and a processing liquid head 8*b* configured to discharge processing liquid that has influences on the ink so as to enhance image quality. Each head 8 is disposed over a section of the feeding path on which the sheet M is horizontally conveyed. The processing liquid head 8*b* is disposed upstream relative to the recording head 8*a* in the feeding direction. Therefore, the processing liquid is discharged onto the recording side of the sheet M earlier than the ink.

In the printer 1, pigment ink is used as the ink discharged by the recording head 8*a*. Further, as the processing liquid, appropriate liquid is selected depending on properties of the ink, from various sorts of liquid that has properties to agglutinate pigment, i.e., a coloring component of the pigment ink and contains polyvalent metal salt such as cationic compound (especially, cationic polymer or cationic surfactant), calcium salt, and magnesium salt. When the ink lands on the recording side of the sheet M on which the processing liquid has previously been applied, the polyvalent metal salt acts on the pigment, such that insoluble or hardly-soluble metallic complex is formed with the pigment being agglutinated. It results in a reduced degree of penetration of the ink into the sheet M. Thus, it is possible to easily fix the ink onto the recording side of the sheet M. Consequently, it is possible to improve the image quality by avoiding bleedthrough and enhancing the image density. When dye ink is used as the ink discharged by the recording head 8*a*, processing liquid is applied as needed that has properties to precipitate dye, i.e., a coloring component of the dye ink.

In the embodiment, the printer 1 is a so-called line-type printer with each head 8 is configured in the same manner. Specifically, each head 8 is formed substantially in a rectangular parallelepiped shape having a longitudinal direction along a width direction (i.e., a direction perpendicular to a plane of FIG. 1). Each head 8 includes a head body 41 configured such that liquid flows therethrough. A lower surface of the head body 41 is formed with a discharging surface 42, which is disposed to face the recording surface of the sheet M conveyed horizontally along the feeding path, across a predetermined distance in the vertical direction. The discharging surface 42 includes a plurality of discharge outlets disposed in the width direction. The liquid flowing in the head body 41 is discharged downward via the discharge outlets. The head body 41 includes a head actuator 61 (see FIG. 2) that applies to liquid discharge energy for discharging the liquid. The controller 9 controls the head actuator 61 such that an appropriate amount of liquid is discharged at an appropriate moment selectively from the discharge outlets, so as to form an image while making the discharged liquid land on the recording side of the sheet M being conveyed.

Each head 8 of the embodiment is configured to form an image in the feeding direction and the width direction with a resolution of 600 dpi. Therefore, on the recording side of the sheet M, a plurality of unit areas (pixel areas) are defined, into which the recording-side surface is sectioned at intervals of 1/600 inches in each of the width direction and a longitudinal direction. Further, on the discharging surface 42, the discharge outlets, of the same number as the number of the unit areas of a single row in the width direction that are defined on the sheet M, are disposed at intervals of 1/600 inches in the width direction. In order to achieve such a microscopic interval, the discharge outlets may be disposed in a staggered arrangement. Namely, a part of the discharge outlets may be disposed in a different position from a position of the other discharge outlets in the feeding direction.

Below each head 8, there is a maintenance unit 45 provided to perform maintenance of the head 8. The maintenance unit 45 includes a cap 46 and pump 47. For example, the cap 46 is configured to move between a withdrawal position where the cap 46 is withdrawn below the feeding path and a protrusion position where the cap 46 protrudes above the feeding path. When the cap 46 is located in the withdrawal position, the sheet M can be conveyed without interference with the maintenance unit 45. Meanwhile, when the cap 46 is located in the protrusion position, the discharging surface 42 comes into close contact with the cap 46 and the discharge outlets of the head 8 are sealed in the cap 46. The pump 47 applies a negative pressure to the inside of the cap 46 where the discharge outlets are sealed, and forcibly sucks in the liquid in the head body 41. Thereby, it is possible to remove air bubbles that have entered into the head body 41 and/or liquid dregs solidified after being dried around discharge outlets. Depending on properties of the liquid such as a volatile property, an amount of the ink removed in a single maintenance operation may be rendered different from an amount of the processing liquid removed in a single maintenance operation. Further, a period (cycle length) of the maintenance repeatedly performed for the recording head 8*a* may be rendered different from a period of the maintenance repeatedly performed for the processing liquid head 8*b*.

At an inner bottom of the housing 2, an attachment portion 2*b* is disposed that is configured such that a liquid cartridge 50 as a liquid supply source is attached thereto. Nonetheless, the attachment portion 2*b* may be disposed in a different position as needed.

The liquid cartridge 50 includes a cartridge body 51 formed substantially in a rectangular parallelepiped shape. In the embodiment, the liquid cartridge 50 is a so-called integrated type of cartridge, which includes in the cartridge body 51 an ink tank 52 configured to store the ink and a processing liquid tank 53 configured to store the processing liquid. When the ink is consumed for reasons such as image formation and the maintenance of the heads 8, the ink stored in the ink tank 52 is supplied to the recording head 8*a* via an ink supply system (not shown). In addition, when the processing liquid is consumed, the processing liquid stored in the processing liquid tank 53 is supplied to the processing liquid head 8*b* via a processing liquid supply system (not shown).

Each of the ink supply system and the processing liquid supply system includes a resin tube via which the liquid cartridge 50 is mechanically connected with a corresponding one of the heads 8. Further, the ink supply system and the processing liquid supply system allow internal spaces of the liquid tanks 52 and 53 to communicate with the portions of the heads 8*a* and 8*b* through which the liquid flows, respectively. The ink supply system may include an ink sub-tank having a smaller capacity than that of the ink tank 52. The ink sub-tank may be attached to the head 8*a* or supported by the housing 2. In this case, responsive to consumption of the ink, the ink is sequentially supplied from the ink sub-tank to the head body 41. When the ink in the ink sub-tank is completely consumed, the ink in the ink tank 52 is supplied into the ink sub-tank. Therefore, an amount of the ink remaining in the ink tank 52 does not vary on a real-time basis in conformity with an amount of the ink consumed by the recording head 8*a*. In the following description, it is noted that the term "remaining ink amount," unless specified otherwise, may represent various meanings that contain not only the amount of the ink remaining in the ink tank 52 of the liquid cartridge 50, but also (in the case where the ink supply system includes the ink sub-tank) a summation of the amount of the ink remaining in the ink tank 52 and the amount of the ink remaining in the ink sub-tank, and a summation of the amount of the ink remaining in the ink tank 52, the amount of the ink remaining in the ink sub-tank, and the amount of the ink remaining in the tube. In other words, the "remaining ink amount" may represent a value obtained by subtracting the amount of the ink consumed after installation of a new liquid cartridge 50 from an initial amount of the ink stored in the liquid cartridge 50. The same applies to the case of the processing liquid.

Figure 2:
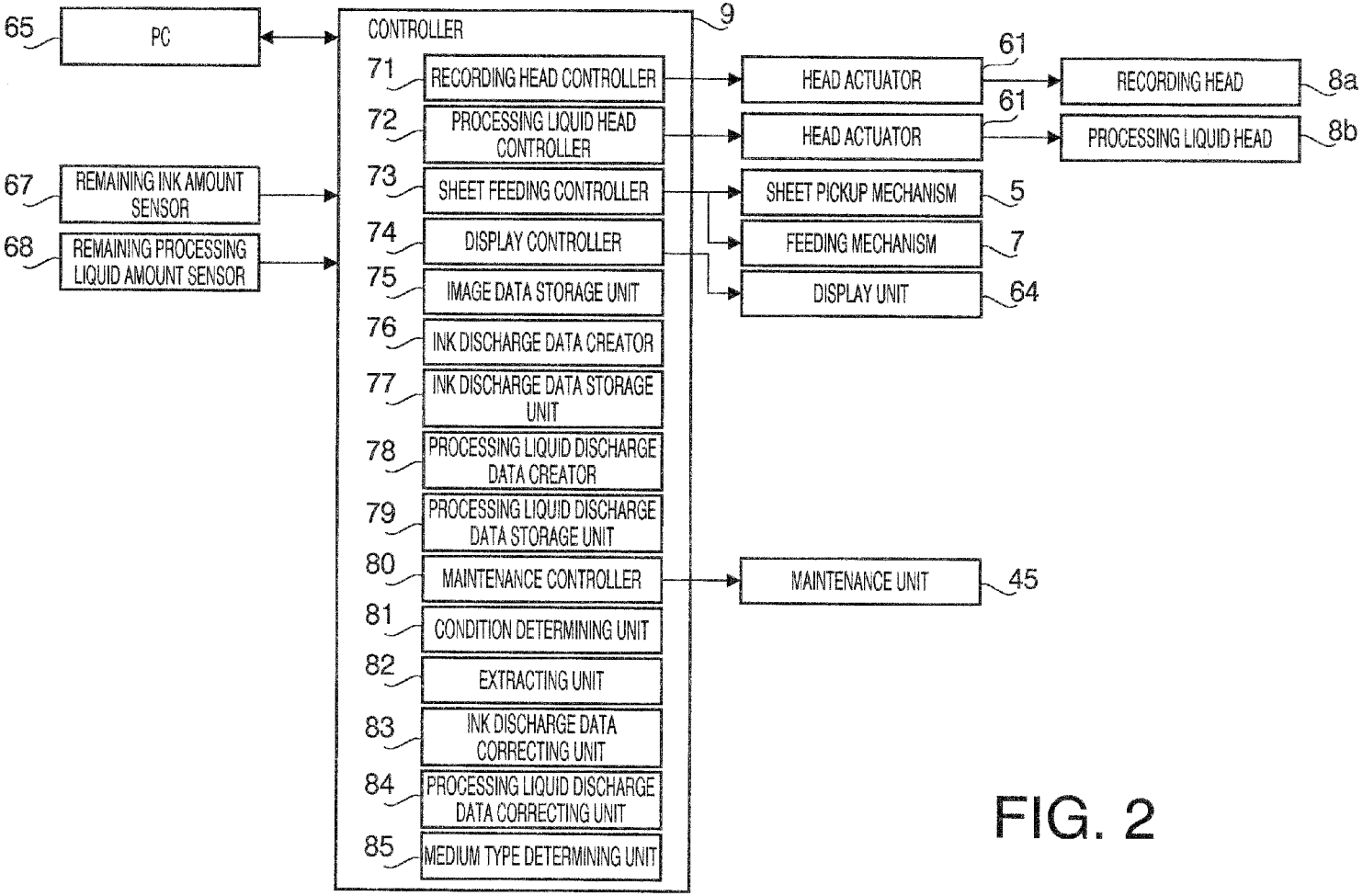
FIG. 2 is a block diagram showing an overall configuration of a controller of the inkjet printer in the embodiment according to one or more aspects of the present invention.

FIG. 2 is a block diagram showing an overall configuration of the controller 9 shown in FIG. 1. The controller 9 shown in FIG. 2 includes a CPU, an EEPROM that stores in a rewritable manner control programs to be executed by the CPU and data to be used when the CPU executes the control programs, and a RAM configured to temporarily store the data during execution of the control programs. When executed by the CPU, the control programs provide functional units 71 to 85 included in the controller 9 as depicted in FIG. 2. It is noted that the control programs may be stored on one or more computer-readable media including but not limited to RAMs, ROMs, flash memories, EEPROMs, CD-media, DVD-media, temporary storage, hard disk drives, floppy drives, permanent storage, and the like, in an encrypted or compressed manner. Further, the control programs stored on the computer-readable media may be executed by the controller 9 directly, or indirectly after installed into the EEPROM.

As illustrated in FIG. 2, the controller 9 includes a recording head controller 71, a processing liquid head controller 72, a sheet feeding controller 73, a display controller 74, an image data storage unit 75, an ink discharge data creator 76, an ink discharge data storage unit 77, a processing liquid discharge data creator 78, a processing liquid discharge data storage unit 79, a maintenance controller 80, a condition determining unit 81, an extracting unit 82, an ink discharge data correcting unit 83, a processing liquid discharge data correcting unit 84, and a medium type determining unit 85.

The sheet feeding controller 73 controls the sheet pickup mechanism 5 to feed the sheet M onto the feeding path as needed, e.g., in response to a print instruction. In addition, the sheet feeding controller 73 controls the feeding mechanism 7 to convey the sheet M onto the catch tray 3. The display controller 74 controls a display unit 64 so that a user can display various kinds of information concerning the printer 1 on the display unit 64. The displayed information includes information representing that the ink or the processing liquid in the liquid cartridge 50 is completely consumed and the liquid cartridge 50 needs to be exchanged. The display unit 64 is placed in such a circumstance that the user can visually recognize what the display unit 64 displays thereon. For example, the display unit 64 may be a monitor device of a personal computer (PC) 65 or a display device (not shown) attached onto an outer face of the housing 2. The maintenance controller 80 determines whether maintenance of the heads 8 is needed, and controls the maintenance unit 45 to perform maintenance of the heads 8 as needed.

The image data storage unit 75 is configured to store image data that is transferred from the PC 65 and to be printed on the sheet M. The ink discharge data creator 76 creates ink discharge data that defines an amount (for instance, one of four degrees, i.e., zero, a small-size droplet, a middle-size droplet, and a large-size droplet) of the ink to be discharged by the recording head 8*a* onto each of the unit areas into which the recording side of the sheet M is sectioned, based on the image data stored in the image data storage unit 75. The ink discharge data created by the ink discharge data creator 76 is stored in the ink discharge data storage unit 77. It is noted that a value of the image data may indicate the amount (for instance, one of four degrees, i.e., zero, a small-size droplet, a middle-size droplet, and a large-size droplet) of the ink to be discharged by the recording head 8*a* onto each of the unit areas into which the recording side of the sheet M is sectioned. In this case, the controller 9 may be configured without the ink discharge data creator 76 or the ink discharge data storage unit 77.

FIG. 3 shows an example of an image to be printed on the sheet M. The shown image is a star-shaped image expressed with shading as a whole. Further, one of five projection areas of the star-shaped image is outlined and a fine linear line is drawn in the outlined projection area. In FIG. 3, the ink is not required to be discharged onto white areas of the outlined projection area. The outlined projection area forms a part of the star-shaped image but is not an image to be formed with the ink being discharged thereon. It is noted that in the following description, the term "image formation area(s)" will be employed to represent area(s) formed with the ink discharged thereon, such as a shading area, edges rimming the shading area, edges rimming the outlined projection area, and the fine linear line drawn in the outlined projection area.

An area IV surrounded by a dashed line in FIG. 3 includes a shading area and an edge rimming the shading area. FIG. 4A exemplifies ink discharge data for unit areas included in the area IV shown in FIG. 3. In FIG. 4A, each of squares represents a single unit area. A character "S," "M," or "L" shown in each square denotes that a small-size droplet, a middle-size droplet, or a large-size droplet of the ink is to be discharged onto the corresponding unit area, respectively. Further, an area without any of the characters "S," "M," and "L" corresponds to a unit area where no ink is to be discharged. The same applies to FIGS. 4B to 4H.

The processing liquid discharge data creator 78 creates processing liquid discharge data based on the image data stored in the image data storage unit 75 or the ink discharge data stored in the ink discharge data storage unit 77. The processing liquid discharge data includes data indicating an amount (for instance, one of four degrees, i.e., zero, a small-size droplet, a middle-size droplet, and a large-size droplet) of the processing liquid to be discharged by the processing liquid head 8*b* onto each of the unit areas into which the recording side of the sheet M is sectioned. The processing liquid discharge data storage unit 79 stores the created processing liquid discharge data. FIG. 4B shows processing liquid discharge data corresponding to the ink discharge data shown in FIG. 4A.

The recording head controller 71 controls the recording head 8*a* to discharge a droplet of the ink onto an intended unit area where an image dot is to be formed, based on the image data stored in the image data storage unit 75. The processing liquid head controller 72 controls the processing liquid head 8*b* to discharge the processing liquid, based on the processing liquid discharge data stored in the processing liquid discharge data storage unit 79.

Based on a remaining ink amount detected by a remaining ink amount sensor 67 and a remaining processing liquid amount detected by a remaining processing liquid amount sensor 68, the condition determining unit 81 determines whether a predetermined condition that the remaining processing liquid amount is less than the remaining ink amount is satisfied. When at least one of the ink and the processing liquid is completely consumed, the display controller 74 controls the display unit 64 to display the information representing that the ink or the processing liquid in the liquid cartridge 50 is completely consumed and the liquid cartridge 50 needs to be exchanged, as exemplified above. The aforementioned determination is made by the condition determining unit 81 when the ink and the processing liquid remain.

The predetermined condition includes a first condition that a subtraction value obtained by subtracting the remaining processing liquid amount from the remaining ink amount is more than a first threshold and a second condition that the remaining processing liquid amount is less than a second threshold. Specifically, the condition determining unit 81 determines whether both the first condition defined by a following expression (1) and the second condition defined by a following expression (2) are satisfied. Then, when determining that both the first condition and the second condition are satisfied, the condition determining unit 81 determines that the predetermined condition is satisfied.

$$A-B>T1 \quad (1)$$

$$B<T2 \quad (2)$$

where "A" represents the remaining ink amount, "B" represents the remaining processing liquid amount, "T1" represents the first threshold, and "T2" represents the second threshold. The first threshold T1 is set to a value equal to or more than zero. The second threshold T2 is set to a value as much as 50 to 75% of the initial amount of the processing liquid stored in the processing liquid tank 53.

Additionally, the first condition may be changed to a condition that a division value obtained by dividing the remaining ink amount by the remaining processing liquid amount is more than another first threshold. In this case, the expression (1) is replaced with a following expression (3).

$$A/B > T1' \quad (3)$$

where T1' represents the first threshold for the first condition defined by the expression (3), and is set to a value equal to or more than one.

When the condition determining unit 81 determines that the predetermined condition is satisfied, as will be described in detail, functional units such as the processing liquid discharge data correcting unit 84 correct the processing liquid discharge data such that in the corrected data, a total amount of the processing liquid discharged onto the image formation areas is less than a total amount of the processing liquid discharged onto the image formation areas in the case where the condition determining unit 81 determines that the predetermined condition is not satisfied. When the predetermined condition is satisfied, the processing liquid head controller 72 controls the processing liquid head 8*b* to discharge, onto the image formation areas, the processing liquid of an amount determined based on the corrected processing liquid discharge data.

The first condition included in the predetermined condition is satisfied when consumption of the processing liquid is more advanced than consumption of the ink, regardless of whether the first condition is defined by the expression (1) or the expression (3). Therefore, the determination as to whether the first condition is satisfied makes it possible to determine in a preferable manner whether the processing liquid is exhausted earlier than the ink. Then, when the first condition is satisfied, the processing liquid is savingly discharged. Thus, when the processing liquid is actually exhausted, the remaining ink amount is as small as practicable.

The saving of the processing liquid is not performed unless the second condition included in the predetermined condition is satisfied concurrently with the first condition. The second condition is satisfied when the processing liquid is consumed to some extent (according to the aforementioned example, when the processing liquid is consumed as much as 50 to 75% of the initial amount of the processing liquid stored in the processing liquid tank 53). Conversely, when the second condition is not satisfied, i.e., when the remaining processing liquid amount is large enough, even though the first condition is satisfied (in this situation, the remaining ink amount shows a further larger value), it is possible to restrain the saving of the discharged amount of the processing liquid, in a preferable manner. Especially, when the liquid cartridge 50 is configured such that the initial amount of the processing liquid stored is less than the initial amount of the ink stored, it is possible to favorably avoid an undesired situation where the processing liquid is discharged in a saving manner immediately after replacement of the liquid cartridge 50.

Hereinafter, explanations will be provided about how to correct the discharged amounts of the processing liquid and the ink in the event where the condition determining unit 81 determines that the predetermined condition is satisfied. Initially, concise explanations will be provided about some points to consider with respect to correction methods for saving the processing liquid.

If the processing liquid to be discharged is saved with no change of the discharged amount of the ink, the pigment contained in the ink becomes less likely to be affected by the processing liquid in comparison with the case where the processing liquid to be discharged is not saved. In this case, the ink becomes less likely to be easily fixed onto the recording side of the sheet M, and likely to penetrate into the sheet M. It might lead to a reduced image density of a resulting image and/or bleeding or bleedthrough of the ink.

When bleeding occurs at the fine linear line or the edges, the bleeding is likely to be distinctly recognized because the bleeding causes the fine line to look thick or causes the edges to look unclear. In other words, the bleeding at the fine linear line or the edges has a significant influence on the image quality of the whole image.

If the processing liquid to be discharged is saved in unit areas that are previously set such that a more amount of the ink is discharged thereon than onto the other unit areas (i.e., according to the aforementioned example, in unit areas that are previously set such that a large-size droplet of the ink is discharged thereon), a more amount of the ink might penetrate into the sheet M in response to the more discharged amount of the ink. Thereby, the bleeding or the bleedthrough might be recognized more distinctly.

Forming the image using the processing liquid is expected to provide effects to enhance an OD (Optical Density) value and a gradation value. Among the unit areas, there are one or more unit areas that are supposed to be supplied with the processing liquid in order to obtain a desired OD value and a desired gradation value (i.e., unit areas supposed not to attain a desired OD value or a desired gradation value without use of the processing liquid).

The printer 1 is used to perform image formation on sheets of various kinds of materials and various thicknesses. Event though the same amount of the ink and the same amount of the processing liquid are discharged, the degrees of the bleeding and the bleedthrough vary depending on the material and the thickness of the sheet. The bleeding and the bleedthrough are more likely to be caused in a sheet of a material having a higher degree of liquid penetration. The same applies to a thinner sheet.

In the embodiment, the extracting unit 82 of the controller 9 extracts a part of the image as a specific part, based on the image data stored in the image data storage unit 75 and the ink discharge data stored in the ink discharge data storage unit 77. The specific part is such a part that if the processing liquid to be discharged thereon is simply saved, the image quality thereof might be deteriorated remarkably (to a distinctly-recognized extent) and/or the deteriorated image quality thereof is supposed to have an influence on the image quality of the whole image. For example, the specific part includes, as described above, the fine line, the edges of the image, areas that are previously set to be supplied with a more amount of the ink, areas that are set with brightness less than a predetermined value, areas of which OD values are determined on the premise of use of the processing liquid, and areas of which gradation values are determined on the premise of use of the processing liquid. Conversely, the image formation areas include the specific part extracted by the extracting unit 82 and a non-specific part not extracted by the extracting unit 82.

Referring to FIGS. 4A and 4B, unit areas corresponding to the edges are indicated by thick-frame squares. The extracting unit 82 extracts unit areas as indicated by thick-frame squares, as the specific part. In FIGS. 4A and 4B, unit areas indicated by squares not surrounded by a thick frame correspond to the non-specific part.

Based on the extraction result by the extracting unit 82, the controller 9 corrects the amounts of the processing liquid and the ink to be discharged onto the specific part and the non-specific part so as to meet two requirements, i.e., maintaining the image quality by preventing deterioration of the image density, bleeding, and bleedthrough in the specific part, and saving the amount of the processing liquid to be discharged onto the entire image formation areas including the non-specific part. The correction of the discharged amount of the processing liquid is performed when the processing liquid discharge data correcting unit 84 corrects the processing liquid discharge data stored in the processing liquid discharge data storage unit 79. The processing liquid discharge data storage unit 79 stores the corrected processing liquid discharge data. The processing liquid head controller 72 controls the head actuator 61 of the processing liquid head 8*b* such that the processing liquid head 8*b* discharges the processing liquid based on the corrected processing liquid discharge data stored in the processing liquid discharge data storage unit 79. The correction of the discharged amount of the ink is performed when the ink discharge data correcting unit 83 corrects the ink discharge data stored in the ink discharge data storage unit 77. The ink discharge data storage unit 77 stores the corrected ink discharge data. The ink head controller 71 controls the head actuator 61 of the recording head 8*a* such that the recording head 8*a* discharges the ink based on the corrected ink discharge data stored in the ink discharge data storage unit 77. Hereinafter, points to consider with respect to correction methods will be described. FIGS. 4C, 4E, and 4G exemplify the ink discharge data corrected in the event where the predetermined condition is satisfied. FIGS. 4D, 4F, and 4H exemplify the processing liquid discharge data corrected in the event where the predetermined condition is satisfied.

A first point is with respect to how to reduce the discharged amount of the processing liquid. Specifically, in a correction method according to the first point, a part of unit areas that are previously determined to be supplied with the discharged processing liquid is supplied with an originally-determined amount of the discharged processing liquid, regardless of whether the predetermined condition is satisfied. Meanwhile, a remainder of the unit areas is not supplied with the processing liquid. In other words, the processing liquid is discharged in a thinning-out manner onto a part of the unit areas that are previously determined to be supplied with the processing liquid (see unit areas showing the non-specific part in FIG. 4D, and unit areas showing the specific part in FIG. 4F). A second point is with respect to how to reduce the discharged amount of the processing liquid. Specifically, in a correction method according to the second point, at least a part of the unit areas that are previously determined to be supplied with the discharged processing liquid is supplied with a smaller amount of the discharged processing liquid than the originally-determined amount (see unit areas showing the non-specific part in FIG. 4F). A third point is with respect to how to reduce the discharged amount of the processing liquid. Specifically, in a correction method according to the third point, the processing liquid is discharged in a thinning-out manner onto a part of the unit areas that are previously determined to be supplied with the processing liquid, as implemented in the first point. Further, as implemented in the second point, at least a part of the unit areas determined to be supplied with the discharged processing liquid is supplied with a smaller amount of the discharged processing liquid than the originally-determined amount (see FIG. 4H). The processing liquid discharge data correcting unit 84 corrects the processing liquid discharge data in the correction method according to one of the first to third points, so as to save the processing liquid to be discharged.

A fourth point is regarding to what extent the discharged amount of the processing liquid is to be reduced. Specifically, in a correction method according to the fourth point, the discharged amount of the processing liquid is reduced at a predetermined constant rate regardless of difference between the remaining amount of the processing liquid and the remaining amount of the ink. The "difference" may be defined by a subtraction value or a division value (a ratio). A fifth point is regarding to what extent the discharged amount of the processing liquid is to be reduced. Specifically, in a correction method according to the fifth point, the discharged amount of the processing liquid is rendered smaller responsive to a larger difference between the remaining amount of the ink and the remaining amount of the processing liquid. Thereby, when the consumed amount of the processing liquid relative to the consumed amount of the ink is larger, the processing liquid is saved more severely. Thus, it is possible to make the remaining amount of the ink after formation of the image close to the remaining amount of the processing liquid.

FIG. 5A exemplifies a relationship between a remaining amount difference and a discharge rate (of the processing liquid). FIG. 5B exemplifies a relationship between a remaining amount ratio and the discharge rate (of the processing liquid). In FIG. 5A, the "remaining amount difference" as a parameter of the horizontal axis is an example of the aforementioned difference between the remaining amount of the processing liquid and the remaining amount of the ink and a value obtained by subtracting the remaining amount of the processing liquid from the remaining amount of the ink. When the predetermined condition is satisfied, the remaining amount difference is a value more than T1. In FIG. 5B, the "remaining amount ratio" as a parameter of the horizontal axis is an example of the aforementioned difference between the remaining amount of the processing liquid and the remaining amount of the ink and a value obtained by dividing the remaining amount of the processing liquid by the remaining amount of the ink. When the predetermined condition is satisfied, the remaining amount ratio is more than zero and less than one. In FIGS. 5A and 5B, the "discharge rate" as a parameter of the vertical axis is a ratio obtained by dividing a total amount of the processing liquid discharged when the predetermined condition is satisfied by a total amount of the processing liquid discharged when the predetermined condition is not satisfied. For instance, a discharge rate of 0.75 denotes that a discharged amount of the processing liquid after the correction is reduced to be 75% of a discharged amount of the processing liquid before correction (namely, the processing liquid to be discharged is 25% saved).

According to the example shown in FIG. 5A, the processing liquid discharge data correcting unit 84 first determines a remaining amount difference, compares the determined remaining amount difference with a plurality of thresholds, and determines which range, of numerical value ranges defined by the plurality of thresholds, the remaining amount difference is included in. Here, four thresholds, i.e., T1, 2T1 (the double value of T1), 3T1 (the triple value of T1), and 4T1 (the quadruple value of T1) are defined. Thereby, four numerical value ranges, i.e., ranges of "T1 to 2T1," "2T1 to 3T1," "3T1 to 4T1," "4T1 and more" are defined. The processing liquid discharge data correcting unit 84 may set the discharge rate to be equal to a larger one of values for two thresholds defining a numerical value range where the determined remaining amount difference is included (see the numerical value ranges of "T1 to 2T1," "2T1 to 3T1," and "3T1 to 4T1"). Thus, when the discharge rate is determined, it is possible to make the amount of the ink remaining after formation of the image close to the remaining amount of the processing liquid in a preferable manner. Further, the processing liquid discharge data correcting unit 84 may set the discharge rate to vary linearly responsive to the determined remaining amount difference (see the numerical value range of "4T1 and more").

According to the example shown in FIG. 5B, the processing liquid discharge data correcting unit 84 first determines a remaining amount ratio, compares the determined remaining amount ratio with a plurality of thresholds, and determines which range, of numerical value ranges defined by the plurality of thresholds, the remaining amount ratio is included in. Here, four numerical value ranges, i.e., ranges of "0 to 0.25," "0.25 to 0.5," "0.5 to 0.75," "0.75 to 1" are defined. The processing liquid discharge data correcting unit 84 may set the discharge rate to be equal to a smaller one of values for two thresholds defining a numerical value range where the determined remaining amount ratio is included (see the numerical value ranges of "0.25 to 0.5," "0.5 to 0.75," and "0.75 to 1"). Further, the processing liquid discharge data correcting unit 84 may set the discharge rate to be equal to the determined remaining amount ratio (see the numerical value range of "0 to 0.25").

A sixth point is with respect to a correction method in which the ink discharge data correcting unit 83 increases the amount of the ink to be discharged onto a unit area where the amount of the processing liquid to be discharged is reduced (see the unit areas showing the non-specific part in each of FIGS. 4C, 4E, and 4F). In this case, it is possible to restrain reduction in the image density that may be caused in response to reduction in the discharged amount of the processing liquid, by increasing the discharged amount of the ink. Further, since the consumed amount of the ink becomes large, it is possible to make the remaining amount of the ink close to the remaining amount of the processing liquid in a preferable manner.

A seventh point is with respect to the discharged amount of the ink. Specifically, in a correction method according to the seventh point, when the predetermined condition is satisfied, the medium type determining unit 85 determines whether the sheet to be conveyed is a first type of sheet or a second type of sheet having a higher degree of penetration than the first type. When the medium type determining unit 85 determines that the sheet to be conveyed is of the second type, the ink discharge data correcting unit 83 reduces the amount of the ink to be discharged onto a unit area where the amount of the processing liquid to be discharged is reduced. In this case, it is possible to prevent bleeding on such a sheet that bleeding is readily caused thereon, in a preferable manner. It is noted that the user can input information on the type of the sheet on which the image is to be printed when inputting a print instruction into the controller 9. The medium type determining unit 85 discriminates the type of the sheet with respect to the degree of penetration, based on the information of the type of the sheet input along with the print instruction. For instance, the medium type determining unit 85 determines a sheet having a thickness equal to or more than a predetermined value as a first type of sheet, and determines a sheet having a thickness less than a predetermined value as a second type of sheet.

An eighth point is with respect to a method for differentiating the specific part from the non-specific part. Specifically, in a method according to the eighth point, the discharged amount of the processing liquid or the ink is not corrected, and the total amount of the processing liquid to be discharged onto the non-specific part is reduced while the amount of the processing liquid to be discharged onto the specific part is not changed regardless of whether the predetermined condition is satisfied (see the unit areas showing the specific part in each of FIGS. 4C and 4D). In this case, it is possible to maintain a high level of image quality of the specific part regardless of whether the predetermined condition is satisfied and to save the processing liquid. Especially, regarding areas each of which is set with an OD value equal to or more than a predetermined value, since the amount of the processing liquid to be discharged onto the areas is not changed, it is possible to prevent the image quality of the areas from being deteriorated.

A ninth point is with respect to a method for differentiating the specific part from the non-specific part. Specifically, in a correction method according to the ninth point, the processing liquid discharge data correcting unit 84 reduces the amount of the processing liquid to be discharged onto at least a part of the specific part. Further, the ink discharge data correcting unit 83 reduces the amount of the ink to be discharged onto unit areas of the specific part where the amount of the processing liquid to be discharged is reduced (see the unit areas showing the specific part in each of FIGS. 4E to 4H). In this case, since the discharged amount of the ink is reduced is response to the discharged amount of the processing liquid being reduced, it is possible to prevent bleeding and bleedthrough in a preferable manner. For instance, it is possible to prevent the fine line from being inappropriately thick and to prevent the edges from being unclear, in a favorable manner. It is noted that in the ninth point, one of the correction methods according to the first to third points may be applied as a method for reducing the amount of the processing liquid to be discharged onto the specific part. In this case, the correction method applied to the specific part may be different from a correction method applied to the non-specific part for correcting the discharged amount of the processing liquid.

The tenth point is a respect that may be added to the sixth point and the eighth point. Specifically, in a correction method according to the tenth point, when the total amount of the ink to be discharged onto the image formation areas in the case where the predetermined condition is satisfied is reduced in comparison with the case where the predetermined condition is not satisfied, the difference in the total amount of the discharged ink is rendered less than the reduction amount of the processing liquid to be discharged. Thereby, it is possible to certainly make the remaining amount of the processing liquid close to the remaining amount of the ink.

As a concrete correction method practicable in consideration of the above points, for example, a following method may be employed. In the method, the correction methods according to the fifth, seventh, and tenth points may be carried out as a premise, and the correction method according to the eighth point may be applied. Additionally, in order to correct the amounts of the processing liquid and the ink to be discharged onto the non-specific part, the correction methods according to the first and sixth points may be applied. In this case, it is possible to attain the aforementioned effects provided by the correction methods according to the first, fifth to eighth, and tenth points.

FIG. 6 is a flowchart showing a procedure of a process to be executed by the controller 9. The procedure of the process shown in FIG. 6 is performed after a main power supply is turned on and a predetermined initial process is completely executed. Firstly, the controller 9 determines whether there is a print instruction issued (S1). When determining that there is not a print instruction issued (S1: No), the controller 9 goes back to S1 (namely, waits for a print instruction to be issued). When determining that there is a print instruction issued (S1: Yes), the controller 9 stores the image data transferred, e.g., by the PC 65 (S2). Then, the controller 9 creates the ink discharge data and the processing liquid discharge data based on the image data (S3), and stores the created data (S4). Subsequently, the controller 9 determines whether the predetermined condition is satisfied, based on the remaining amount of the ink and the remaining amount of the processing liquid (S5). When determining that the predetermined condition is not satisfied (S5: No), the controller 9 controls the head actuators 61 to cause the processing liquid head 8*b* and the recording head 8*a* to discharge the processing liquid and the ink based on the processing liquid discharge data and the ink discharge data stored in S4, respectively (S6). When completely executing all print jobs assigned by the print instruction (S7), the controller 9 waits for another print instruction to be issued (S1).

When determining that the predetermined condition is satisfied (S5: Yes), the controller 9 determines the type of the sheet based on the information on the type of the sheet that has been input along with the print instruction (S11). The controller 9 determines the discharge rate of the processing liquid depending on the difference between the remaining amount of the ink and the remaining amount of the processing liquid (S12). Subsequently, the controller 9 extracts the specific part based on the image data stored in the image data storage unit 75 or the ink discharge data stored in the ink discharge data storage unit 77 (S13). Then, the controller 9 corrects the processing liquid discharge data stored in the processing liquid discharge data storage unit 79 and the ink discharge data stored in the ink discharge data storage unit 77, based on the type of the sheet determined in S11 and the discharge rate of the processing liquid determined in S12 (S14). In S14, the controller 9 corrects the specific part, of the image formation areas, extracted in S13, in the aforementioned manner to maintain the image quality of the specific part.

Next, the controller 9 stores the corrected ink discharge data in the ink discharge data storage unit 77, and stores the corrected processing liquid discharge data in the processing liquid discharge data storage unit 79 (S15). Then, the controller 9 controls the head actuators 61 to cause the processing liquid head 8*b* and the recording head 8*a* to discharge the processing liquid and the ink based on the corrected processing liquid discharge data and the corrected ink discharge data stored in S15, respectively (S6). When completely executing the print jobs assigned by the print instruction (S7), the controller 9 waits for another print instruction to be issued (S1).

Thus, in the procedure of the process of the embodiment, regardless of whether the predetermined condition is satisfied, once the controller 9 begins to form the image, the controller 9 does not determine whether the predetermined condition is satisfied, until the controller 9 completes execution of the all print jobs. Thereby, since the discharge rate of the processing liquid does not vary during a printing operation, it is possible to maintain the image quality evenly over the printing operation. Further, since an operation of correcting the processing liquid discharge data or the ink discharge data is not performed during the printing operation, it is possible to avoid an undesired situation where the printing operation takes a long time. It is noted that the processing liquid, which can be defined as liquid acting on the ink, may include coating liquid for coating and protecting the ink.

Hereinabove, the embodiment according to aspects of the present invention has been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only an exemplary embodiment of the present invention and but a few examples of their versatility are shown and described in the present disclosure. It is to be understood that the present invention is capable of use in various other combinations and environments and is capable of changes or modifications within the scope of the inventive concept as expressed herein. For example, the following modifications are feasible.

<Modifications>

Each head actuators 61 may be unimorph type piezoelectric actuators or bimorph type piezoelectric actuators. Further, each head actuators 61 may be configured to apply the discharge energy in another method such as a thermal method. Namely, each actuator is not limited to an actuator configured to convert electric power into displacement. Further, in the aforementioned embodiment, the line-type inkjet head is used. However, aspects of the present invention may be applied to a serial inkjet head configured to move in the width direction. It is noted that aspects of the present invention may be applied to a liquid discharger configured to discharge liquid other than ink. Furthermore, aspects of the present invention may be applied to not only a printer but also a facsimile machine or a copy machine. Moreover, the influences of the processing liquid on the ink may include agglutinating or precipitating components (such as pigment and dye) contained in the ink in a chemical reaction caused as a result of the processing liquid mixing with the ink.

What is claimed is:

1. A liquid discharger comprising:

a liquid cartridge comprising:

a first liquid tank configured to store first liquid for forming an image on a sheet; and a second liquid tank configured to store second liquid that acts on the first liquid;

an attachment unit configured such that the liquid cartridge is attached thereto;

a first liquid discharge head configured to discharge, onto the sheet, the first liquid supplied from the first liquid tank;

a second liquid discharge head configured to discharge, onto the sheet, the second liquid supplied from the second liquid tank;

a storage unit configured to store image data of the image to be formed on the sheet;

a first liquid discharge controller configured to control the first liquid discharge head to discharge the first liquid onto image formation areas on the sheet where the image is formed, based on the image data stored in the storage unit;

a second liquid discharge controller configured to control the second liquid discharge head to discharge the second liquid onto at least a part of the image formation areas, based on the image data stored in the storage unit;

a first liquid remaining amount detector configured to detect a remaining amount of the first liquid stored in the first liquid tank;

a second liquid remaining amount detector configured to detect a remaining amount of the second liquid stored in the second liquid tank; and a condition determining unit configured to, based on the remaining amount of the first liquid detected by the first liquid remaining amount detector and the remaining amount of the second liquid detected by the second liquid remaining amount detector, determine whether a predetermined condition is satisfied under a situation where the remaining amount of the second liquid is less than the remaining amount of the first liquid, wherein when the condition determining unit determines that the predetermined condition is satisfied, the second liquid discharge controller controls the second liquid discharge head to discharge onto the image formation areas the second liquid of an amount smaller than an amount of the second liquid to be discharged onto the image formation areas in a case where the condition determining unit determines that the predetermined condition is not satisfied, wherein the predetermined condition comprises a condition that a division value obtained by dividing the remaining amount of the first liquid detected by the first liquid remaining amount detector by the remaining amount of the second liquid detected by the second liquid remaining amount detector is more than a first threshold.

2. The liquid discharger according to claim 1, wherein the predetermined condition comprises a condition that a subtraction value obtained by subtracting the remaining amount of the second liquid detected by the second liquid remaining amount detector from the remaining amount of the first liquid detected by the first liquid remaining amount detector is more than a second threshold.

3. The liquid discharger according to claim 2, wherein when the condition determining unit determines that the predetermined condition is satisfied, the second liquid discharge controller controls the second liquid discharge head to discharge onto the image formation areas the second liquid of an amount that is smaller as the subtraction value is larger.

4. The liquid discharger according to claim 1, wherein the predetermined condition further comprises a condition that the remaining amount of the second liquid detected by the second liquid remaining amount detector is less than a third threshold.

5. The liquid discharger according to claim 1, wherein when the condition determining unit determines that the predetermined condition is satisfied, the second liquid discharge controller controls the second liquid discharge head to discharge onto the image formation areas the second liquid of the amount smaller than the amount of the second liquid to be discharged onto the image formation areas in the case where the condition determining unit determines that the predetermined condition is not satisfied, by defining, within the image formation areas, a discharged part onto which the second liquid is discharged and an undischarged part onto which the second liquid is not discharged.

6. The liquid discharger according to claim 1, wherein when the condition determining unit determines that the predetermined condition is satisfied, the second liquid discharge controller defines a discharged part within the image formation areas onto which part the second liquid is discharged, and controls the second liquid discharge head to discharge, onto at least one part of the discharged part, the second liquid of an amount smaller than an amount of the second liquid to be discharged onto the at least one part of the discharged part in the case where the condition determining unit determines that the predetermined condition is not satisfied.

7. The liquid discharger according to claim 1, wherein when the condition determining unit determines that the predetermined condition is satisfied, the first liquid discharge controller controls the first liquid discharge head to discharge, onto the image formation areas, the first liquid of an amount larger than an amount of the first liquid to be discharged onto the image formation areas in the case where the condition determining unit determines that the predetermined condition is not satisfied.

8. The liquid discharger according to claim 7, further comprising an extracting unit configured to extract a part of the image as a specific part based on the image data, wherein when the condition determining unit determines that the predetermined condition is satisfied, the first liquid discharge controller controls the first liquid discharge head to discharge, onto a first area of the image formation areas that corresponds to the extracted specific part, the first liquid of an amount smaller than an amount of the first liquid to be discharged onto the first area in the case where the condition determining unit determines that the predetermined condition is not satisfied.

9. The liquid discharger according to claim 8, wherein the second liquid acts on the first liquid so as to agglutinate or precipitate a component contained in the first liquid, and wherein the specific part comprises at least one of a pixel area having a brightness less than a predetermined value, a pixel area corresponding to an edge of the image, and a pixel area corresponding to a fine line of the image.

10. The liquid discharger according to claim 1, further comprising an extracting unit configured to extract a part of the image as a specific part based on the image data, wherein when the condition determining unit determines that the predetermined condition is satisfied, the second liquid discharge controller controls the second liquid discharge head to discharge, onto a second area of the image formation areas that corresponds to a non-specific part other than the extracted specific part, the second liquid of an amount smaller than an amount of the second liquid to be discharged onto the second area in the case where the condition determining unit determines that the predetermined condition is not satisfied.

11. The liquid discharger according to claim 10, wherein the second liquid acts on the first liquid so as to agglutinate or precipitate a component contained in the first liquid, and wherein the specific part comprises at least one of a pixel area where the first liquid of an amount equal to or more than a predetermined value, a pixel area having a brightness less than a predetermined value, a pixel area corresponding to an edge of the image, and a pixel area corresponding to a fine line of the image.

12. The liquid discharger according to claim 1, further comprising a sheet type determining unit configured to determine whether the sheet on which the image is to be formed is a first type of sheet or a second type of sheet having a higher degree of liquid penetration than the first type of sheet, wherein when the condition determining unit determines that the predetermined condition is satisfied and the sheet type determining unit determines that the sheet is the second type of sheet, the first liquid discharge controller controls the first liquid discharge head to discharge, onto the image formation areas, the first liquid of an amount smaller than the amount of the first liquid to be discharged onto the image formation area in the case where the condition determining unit determines that the predetermined condition is not satisfied.

13. An image forming apparatus configured to form an image on a sheet while discharging first liquid onto the sheet, comprising:

a feeding mechanism configured to feed the sheet in a feeding direction; and a liquid discharger that comprises:

a liquid cartridge comprising:

a first liquid tank configured to store first liquid for forming the image on the sheet; and a second liquid tank configured to store second liquid that acts on the first liquid;

an attachment unit configured such that the liquid cartridge is attached thereto;

a first liquid discharge head configured to discharge, onto the sheet being fed by the feeding mechanism, the first liquid supplied from the first liquid tank;

a second liquid discharge head configured to discharge, onto the sheet being fed by the feeding mechanism, the second liquid supplied from the second liquid tank;

a storage unit configured to store image data of the image to be formed on the sheet;

a first liquid discharge controller configured to control the first liquid discharge head to discharge the first liquid onto image formation areas on the sheet where the image is formed, based on the image data stored in the storage unit;

a second liquid discharge controller configured to control the second liquid discharge head to discharge the second liquid onto at least a part of the image formation areas, based on the image data stored in the storage unit;

a first liquid remaining amount detector configured to detect a remaining amount of the first liquid stored in the first liquid tank;

a second liquid remaining amount detector configured to detect a remaining amount of the second liquid stored in the second liquid tank; and a condition determining unit configured to, based on the remaining amount of the first liquid detected by the first liquid remaining amount detector and the remaining amount of the second liquid detected by the second liquid remaining amount detector, determine whether a predetermined condition is satisfied under a situation where the remaining amount of the second liquid is less than the remaining amount of the first liquid, wherein when the condition determining unit determines that the predetermined condition is satisfied, the second liquid discharge controller controls the second liquid discharge head to discharge onto the image formation areas the second liquid of an amount smaller than an amount of the second liquid to be discharged onto the image formation areas in a case where the condition determining unit determines that the predetermined condition is not satisfied, wherein the predetermined condition comprises a condition that a division value obtained by dividing the remaining amount of the first liquid detected by the first liquid remaining amount detector by the remaining amount of the second liquid detected by the second liquid remaining amount detector is more than a first threshold.

14. The image forming apparatus according to claim 13, wherein the predetermined condition comprises a condition that a subtraction value obtained by subtracting the remaining amount of the second liquid detected by the second liquid remaining amount detector from the remaining amount of the first liquid detected by the first liquid remaining amount detector is more than a second threshold.

15. The image forming apparatus according to claim 13, wherein the predetermined condition further comprises a condition that the remaining amount of the second liquid detected by the second liquid remaining amount detector is less than a third threshold.

16. The image forming apparatus according to claim 13, wherein when the condition determining unit determines that the predetermined condition is satisfied, the second liquid discharge controller controls the second liquid discharge head to discharge onto the image formation areas the second liquid of the amount smaller than the amount of the second liquid to be discharged onto the image formation areas in the case where the condition determining unit determines that the predetermined condition is not satisfied, by defining, within the image formation areas, a discharged part onto which the second liquid is discharged and an undischarged part onto which the second liquid is not discharged.

17. The image forming apparatus according to claim 13, wherein when the condition determining unit determines that the predetermined condition is satisfied, the second liquid discharge controller defines a discharged part within the image formation areas onto which part the second liquid is discharged, and controls the second liquid discharge head to discharge, onto at least one part of the discharged part, the second liquid of an amount smaller than an amount of the second liquid to be discharged onto the at least one part of the discharged part in the case where the condition determining unit determines that the predetermined condition is not satisfied.

18. The image forming apparatus according to claim 13, wherein when the condition determining unit determines that the predetermined condition is satisfied, the first liquid discharge controller controls the first liquid discharge head to discharge, onto the image formation areas, the first liquid of an amount larger than an amount of the first liquid to be discharged onto the image formation areas in the case where the condition determining unit determines that the predetermined condition is not satisfied.

* * * * *